US008359697B2

(12) United States Patent
Wang

(10) Patent No.: US 8,359,697 B2
(45) Date of Patent: Jan. 29, 2013

(54) TOOTHBRUSH

(76) Inventor: Jui-Chi Wang, Taipei (TW)

( * ) Notice: Subject to any disclaimer, the term of this patent is extended or adjusted under 35 U.S.C. 154(b) by 1193 days.

(21) Appl. No.: 12/121,857

(22) Filed: May 16, 2008

(65) Prior Publication Data

US 2008/0301894 A1 Dec. 11, 2008

(30) Foreign Application Priority Data

Jun. 11, 2007 (TW) ..... 96121060 A

(51) Int. Cl.
*A46B 9/04* (2006.01)

(52) U.S. Cl. ..... 15/167.1; 15/201; 15/22.1; 15/28

(58) Field of Classification Search ..... 15/167.1, 15/167.2; *A46B 9/04*
See application file for complete search history.

(56) References Cited

U.S. PATENT DOCUMENTS

| | | | | |
|---|---|---|---|---|
| 4,330,896 | A | 5/1982 | Booth | |
| 4,502,177 | A | 3/1985 | Beggs | |
| 5,242,301 | A | 9/1993 | Hickey et al. | |
| 2006/0225235 | A1 * | 10/2006 | Mortimer | 15/167.2 |
| 2008/0201880 | A1 * | 8/2008 | Battaglia | 15/88.4 |
| 2009/0113650 | A1 * | 5/2009 | Flek Jr. et al. | 15/167.1 |

FOREIGN PATENT DOCUMENTS

JP 2007105449 A 4/2007

* cited by examiner

*Primary Examiner* — Monica Carter
*Assistant Examiner* — Stephanie N Berry
(74) *Attorney, Agent, or Firm* — Alan Kamrath; Kamrath IP Lawfirm, PA

(57) ABSTRACT

A toothbrush includes a head portion having bristles thereon, a neck portion, and a handle. One end of the neck portion is connected to the head portion, and the other end is connected to the handle. The axis of the bristles is substantially parallel to the axis of the neck portion. The axis of the neck portion and the axis of the handle form an angle. Accordingly, the toothbrush can be used easily for brushing, and it reduces angle limitations when cleaning the inner surface of teeth.

14 Claims, 12 Drawing Sheets

TOOTHBRUSH

BACKGROUND OF THE INVENTION

1. Field of the Invention

The present invention relates to the field of toothbrushes, and more particularly, the invention relates to a toothbrush that has a unique angle which can aid in cleansing the inner surface of teeth.

2. Description of the Related Art

The condition of teeth is closely related to the health condition of mankind. Thus, in modern days, people have paid much attention to the concept of "prevention is better than cure", which encourages people to establish good oral hygiene and maintain healthy teeth. Generally speaking, the health condition of teeth is established during its early stages. During the formation stage, the condition of teeth can deteriorate if they are not treated with proper care. Although fillings and dentures can be applied to repair damaged teeth, teeth having artificial replacements can never be as good as natural ones.

Many medical reports have indicated that decayed teeth (dental caries) originate from the inner surface of the tooth. In the marketplace, the handle of traditional toothbrushes is either straight or slightly curved and with the bristles perpendicular to the handle. The design of these traditional toothbrushes has certain angle limitations on hand movements. They are suitable for cleaning the outer surface of teeth, but the inner surface of teeth, where the dental caries often take place, cannot be easily cleaned.

Furthermore, the bristles on the head portion of traditional toothbrushes are often integrated with the body of the toothbrush. The marketplace does not offer a toothbrush that allows replacing the bristles alone to suit the requirements of different users.

The prevention of dental caries relies heavily on the individual's hygienic habit, and thus, it is crucial to choose a right toothbrush. However, the types of toothbrushes that the marketplace offers are very much limited. Generally, doctors can only recommend the types of "bristles" or "handles" for their clients to choose from. Thus, the present invention has made an improvement on the toothbrushes in the prior art to resolve these problems.

SUMMARY OF THE INVENTION

The main object of the present invention is to provide a toothbrush which has a handle structured in a special angle and which is especially designed to aid the plaque removal process for the inner surface of teeth.

Another object of the present invention is to provide a toothbrush that can reduce the angle limitations on hand movements, which increases the effectiveness for cleaning the inner surface of teeth.

Yet another object of the present invention is to provide a toothbrush which can clean different types of teeth surfaces, as well as the gaps between the teeth. The design of a replaceable head portion (including the bristles), enables the toothbrush to cater to users with different requirements.

In order to achieve the aforementioned objectives, the present invention provides a toothbrush comprising a head portion having bristles thereon, a neck portion, and a handle. One end of the neck portion is connected to the head portion, and the other end is connected to the handle. The axis of the bristles is substantially parallel to the axis of the neck portion. The axis of the neck portion and the axis of the handle form an angle. Accordingly, the present invention reduces the angle limitation when cleaning, and the toothbrush can be inserted easily into the user's mouth for brushing the inner surface of teeth. Furthermore, the present invention comprises a replaceable head portion, which can be replaced by the most suitable head portion to clean different types of teeth surfaces as well as the gaps between teeth. The head portion can also have bristles on both its sides, which aids in maintaining good oral hygiene (especially for the inner surface of teeth) and prevents health problems.

In the embodiments of the present invention, the head portion, the neck portion, and/or the handle can be modeled in one piece or separated such that the neck portion can rotate with respect to the handle and/or the head portion can rotate with respect to the neck portion. oral hygiene (especially for the inner surface of teeth) and prevents health problems.

DETAILED DESCRIPTION OF THE PREFERRED EMBODIMENTS

The advantages and innovative features of the invention can become more apparent with the following preferred embodiments.

Figure 1:
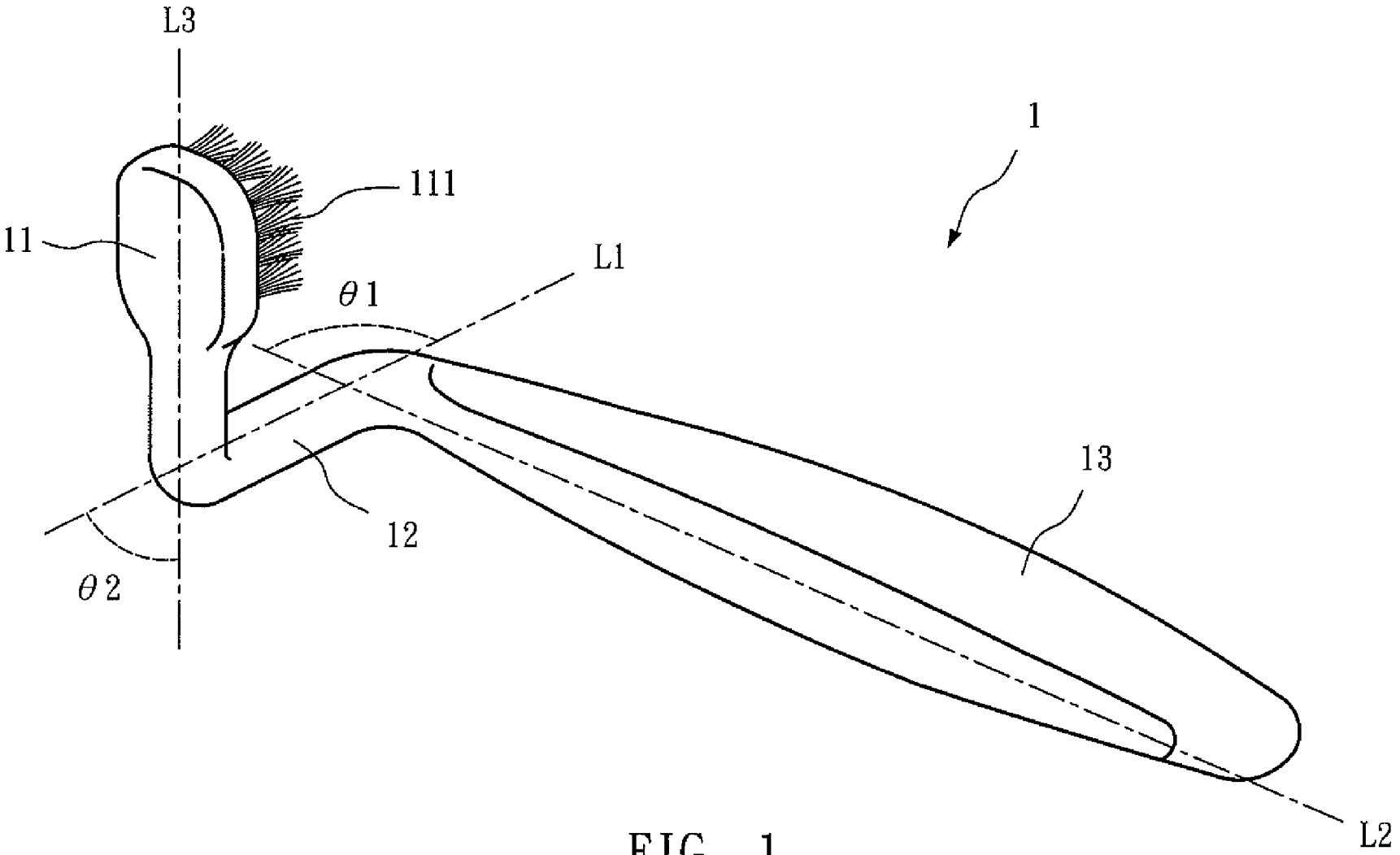
FIG. 1 is a perspective view of a toothbrush embodiment in accordance with the present invention.

Refer to FIG. 1 for the first embodiment of the present invention. The first embodiment of the present invention provides a toothbrush 1, which comprises a head portion 11, a neck portion 12, and a handle 13. The neck portion 12 is extended from the head portion 11, and the handle 13 is extended from the neck portion 12. The head portion 11 comprises bristles 111, and the axis of the bristles 111 is substantially parallel to the axis L1 of the neck portion 12. The axis L1 of the neck portion 12 and the axis L2 of the handle 13 form an angle θ1 . The preferred angle for the angle θ1 lies between 90 and 150 degrees.

The axis L3 of the head portion 11 and the axis L1 of the neck portion 12 further form an angle θ2. The preferred angle for the angle θ2 lies between 70 and 100 degrees. As shown in FIG. 1 the angle θ1 formed b the neck portion 12 and the handle 13 lies in another plane than the angle θ2 formed by the neck portion 12 and the head portion 11. That is, the angle θ1 formed by the neck portion 12 and the handle 13 forms one plane (X-Y plane), and the angle θ2 formed by the neck portion 12 and the head portion 11 forms another plane (X-Z plane). In other words, the axis L1 of the neck portion 12 and the axis L2 of the handle 13 form one plane (X-Y plane), and the axis L1 of the neck portion 12 and the axis L3 of the head portion 11 form another plane (X-Z). Thus the toothbrush 1 of the present invention can be easier for the user to use, that is, the user can hold the toothbrush 1 very easily beside his/her mouth.

Figure 2:
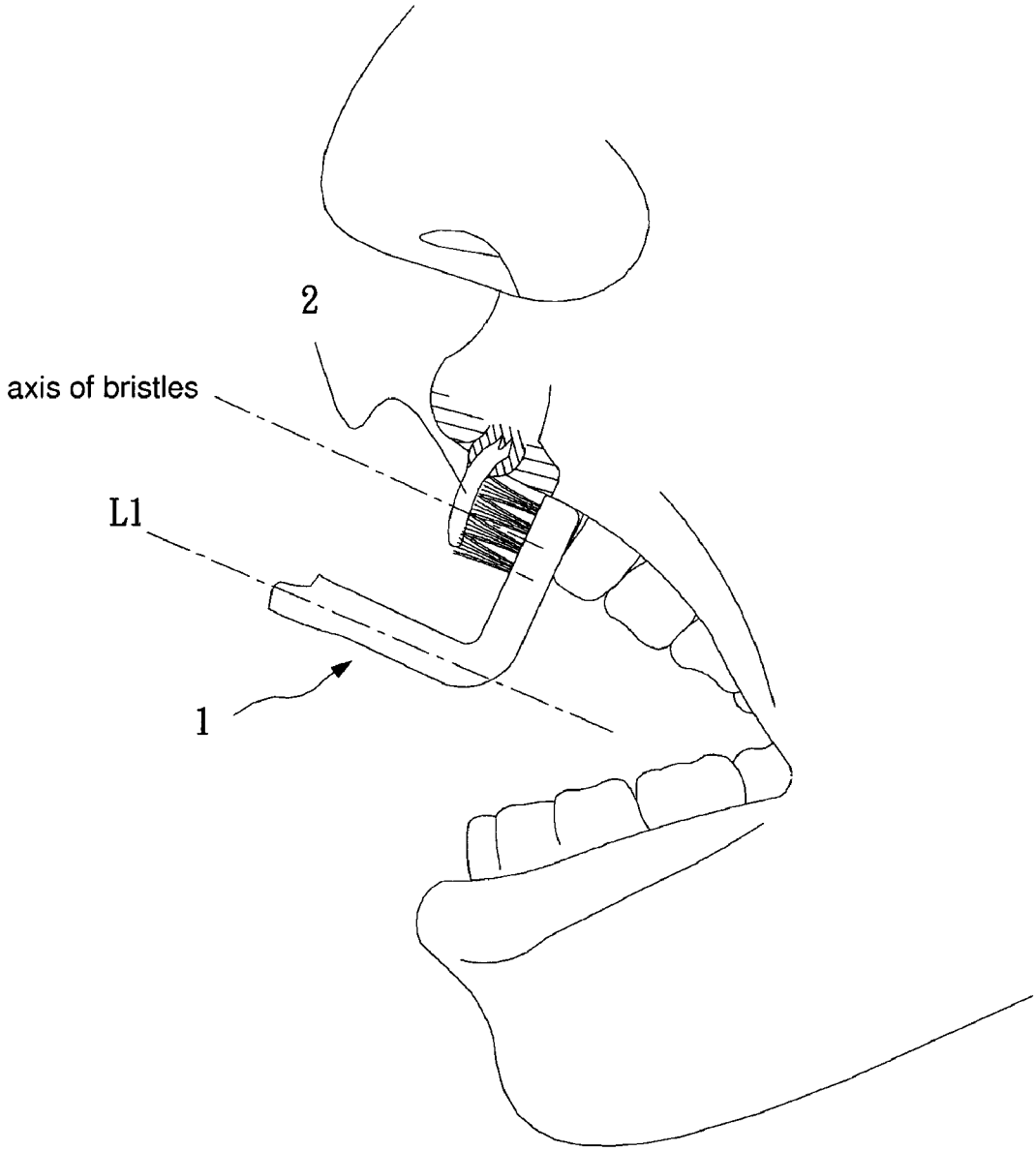
FIG. 2 is a usage diagram in accordance with the embodiment as shown in FIG. 1.

Through the above design, the toothbrush 1 is able to reduce the angle limitation on hand movements, and it makes the teeth-brushing process more convenient. Also refer to FIG. 2. The toothbrush 1 of the present invention can be inserted easily into the user's mouth to increase the effectiveness on brushing the inner surface of the tooth 2.

Figure 3A:
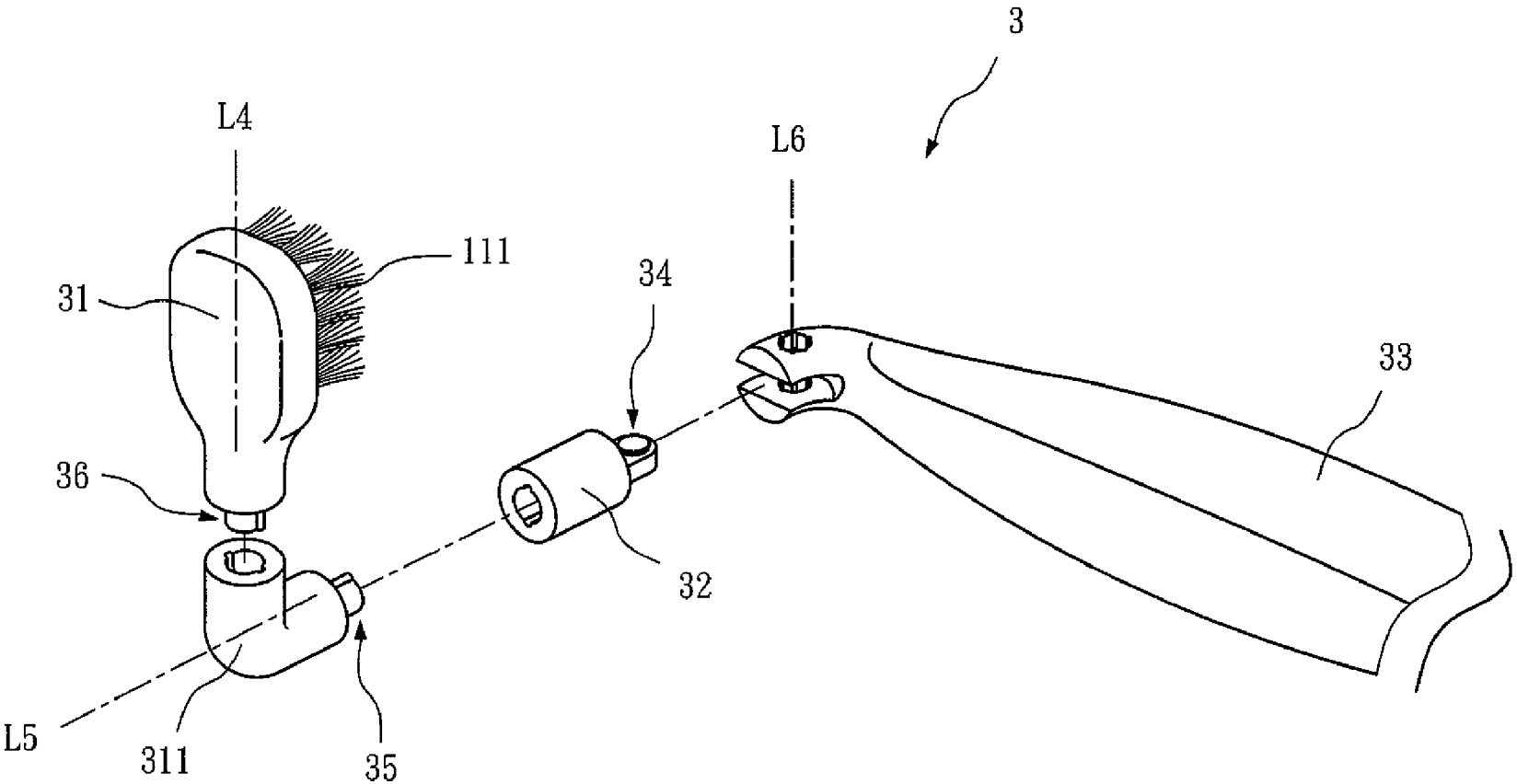
FIG. 3A to FIG. 3E are perspective views of different toothbrushes in accordance with the present invention.

Refer to FIG. 3A for another embodiment of the present invention. This embodiment provides a toothbrush 3. The toothbrush 3 comprises a head portion 31, a neck portion 32, and a handle 33. The neck portion 32 is separately connected to the handle 33 and the head portion 31. Preferably, toothbrush 3 can further comprise an L-shaped member 311.

Furthermore, the embodiment as shown in FIG. 3A of the present invention has one end of the L-shaped member 311 connected to the neck portion 32 by a second rotating member 35. On the other end, the L-shaped member 311 is connected to the head portion 31 by a third rotating member 36. The neck portion 32 and the handle 33 can be connected to each other through a first rotating member 34. Angle adjustments can be made on each connection separately to improve operation efficiency.

According to the embodiment in FIG. 3A, the handle 33 can rotate with respect to the neck portion 32 and/or the head portion 31 can rotate with respect to the neck portion 32. This design has provided users with a more flexible toothbrush. By referring to FIG. 3B concurrently, the head portion 31 and the L-shaped member 311 are connected by the third rotating member 36 (shown in FIG. 3A). The head portion 31 can rotate with respect to the L-shaped member 311. For example, the head portion 31 can rotate with the third rotating member 36 along the axis L4.

Figure 3C:
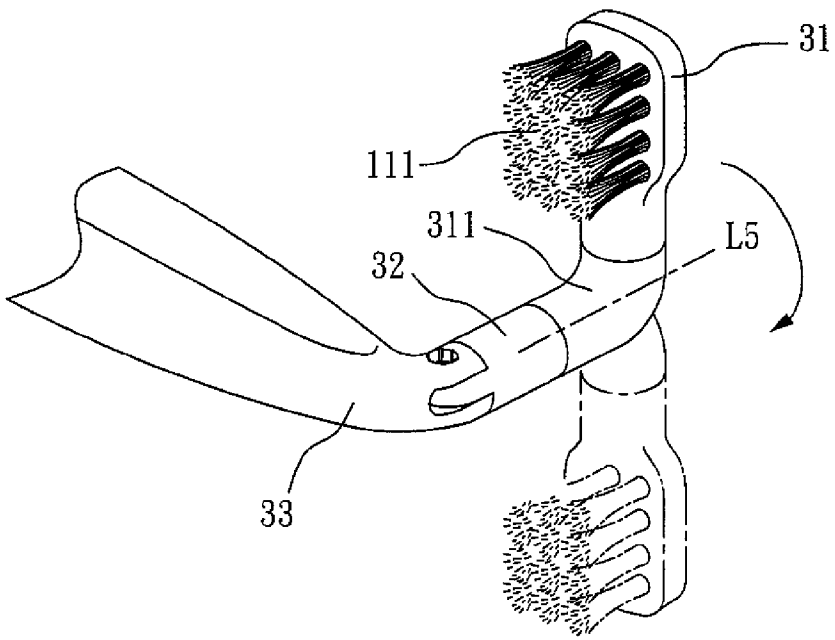
Figure 3B:
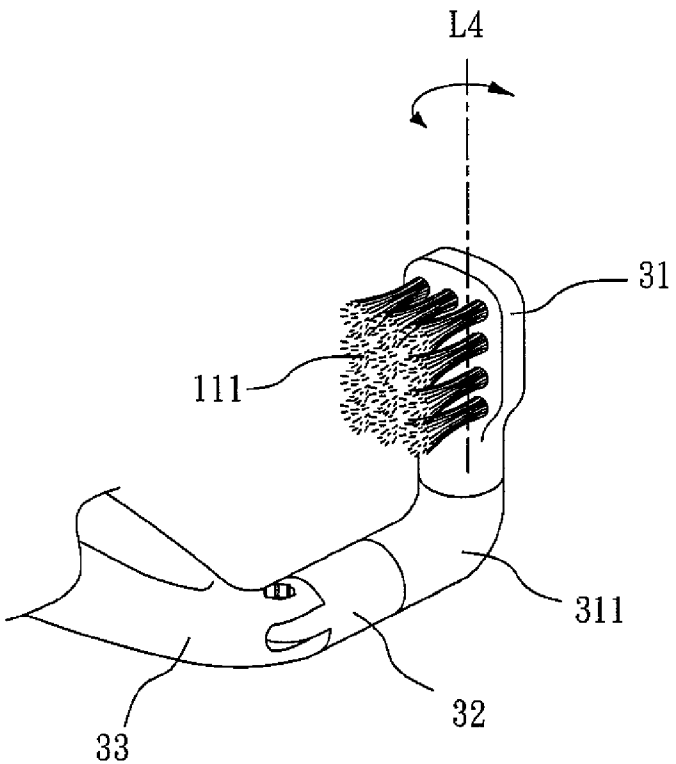

FIG. 3C shows that the neck portion 32 and the L-shaped member 311 are connected by the second rotating member 35 (shown in FIG. 3A). The head portion 31 and the L-shaped member 311 can rotate with respect to the neck portion 32. For example, they can rotate with the second rotating member 35 along the axis L5.

Figure 3D:
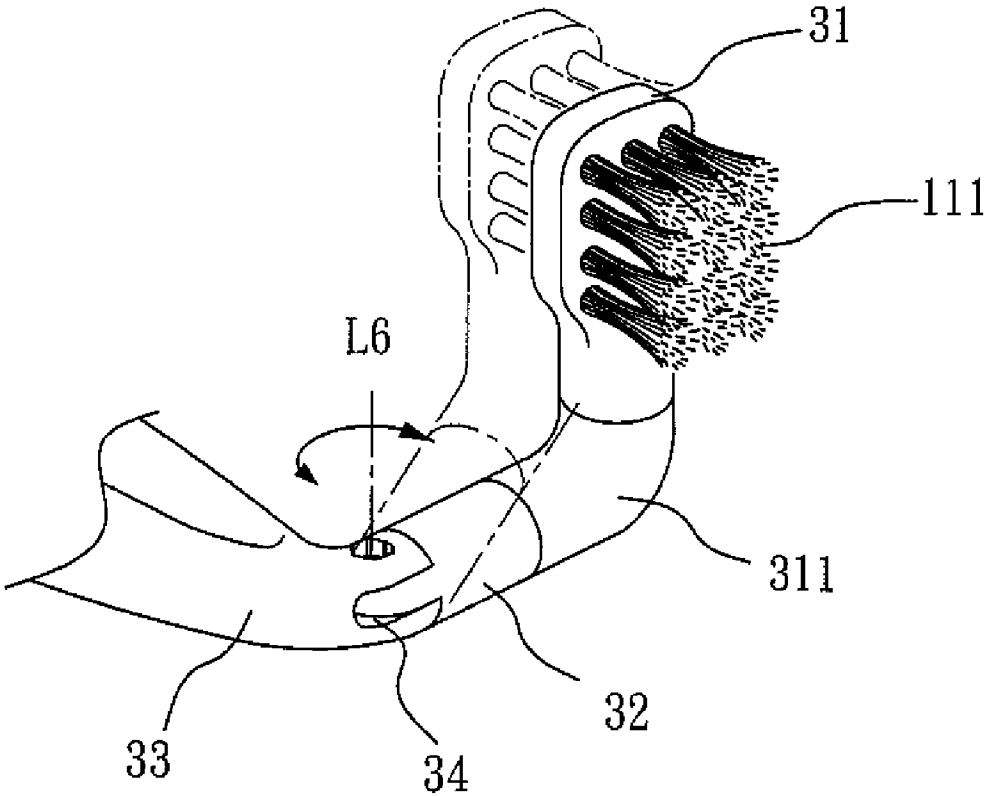

FIG. 3D shows that the neck portion 32 and the handle 33 are connected by the first rotating member 34. The handle 33 can rotate with respect to the neck portion 32. For example, the handle 33 can rotate with the first rotating member 34 along the axis L6.

Figure 3E:
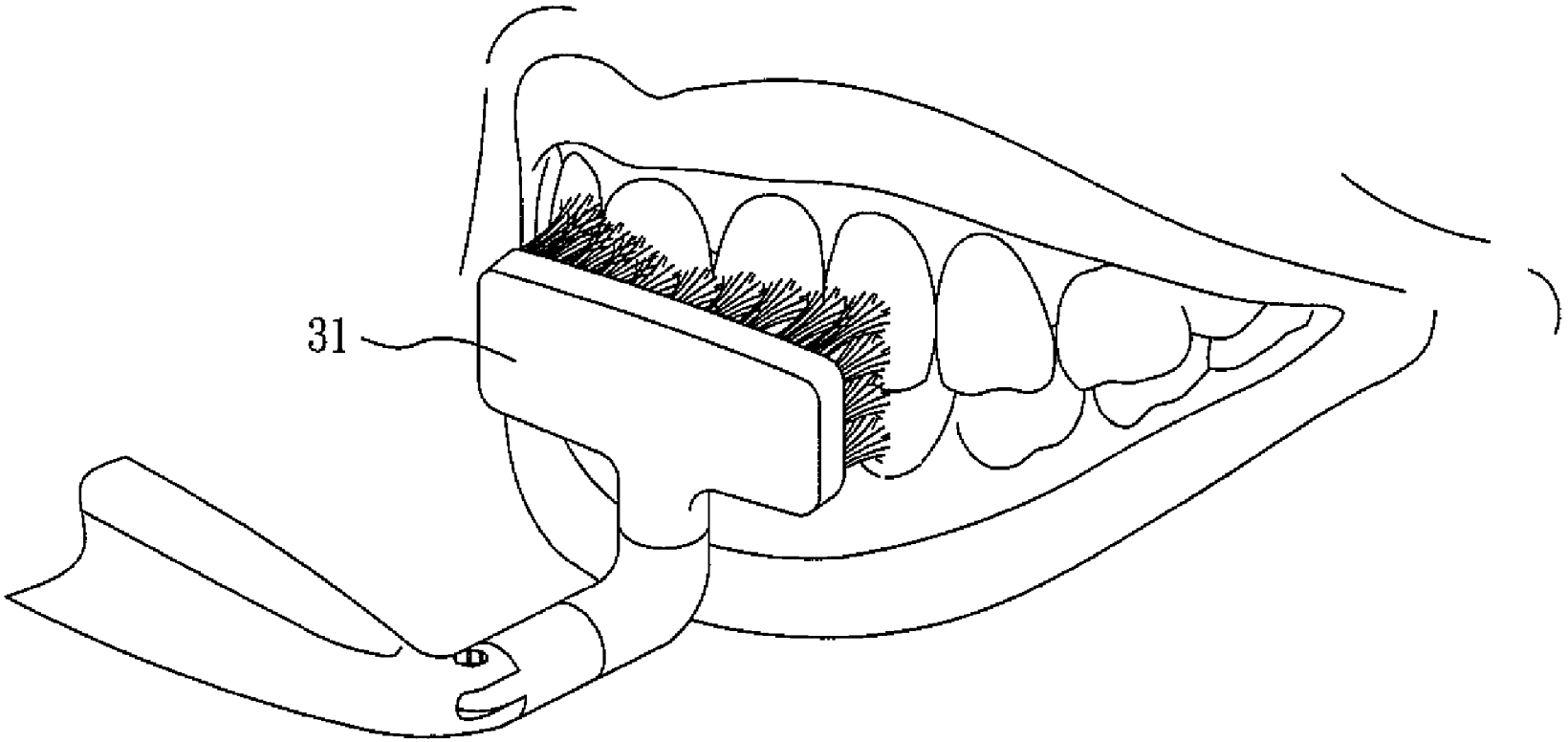

Furthermore, refer to FIG. 3E for a toothbrush which is designed for brushing different types of teeth surfaces as well as the gaps between teeth. The present invention allows the replacement of the head portion 31, so that the most appropriate head portion (including the bristles) can be selected. For example, the head portions and bristles of a different type or size can be selected as a replacement.

Figure 4:
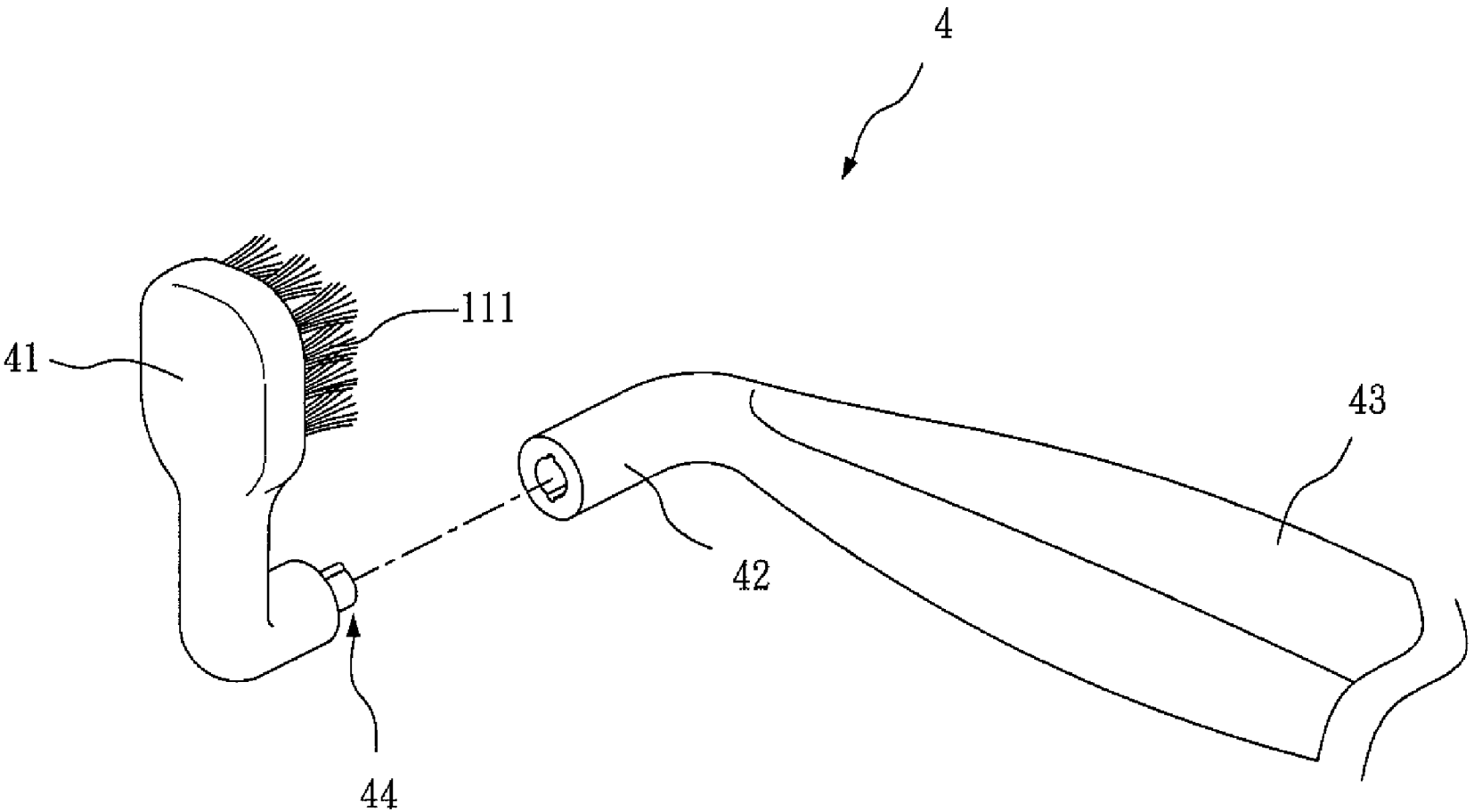
FIG. 4 to FIG. 6 are perspective views showing various embodiments of toothbrushes in accordance with the present invention.

The head portion, the neck portion, the L-shaped member, and/or the handle of the present invention can be modified to generate various embodiments. Refer to the embodiment as shown in FIG. 4. A toothbrush 4 comprises an L-shaped head portion 41, a neck portion 42, and a handle 43 extended from the neck portion 42. In other words, this embodiment has essentially constructed the L-shaped head portion 41 by joining the head portion 31 and the L-shaped member 311 shown in FIG. 3A into a single member. The L-shaped head portion 41 can rotate with respect to the neck portion 42 by rotating along the fifth rotating member 44.

Figure 5:
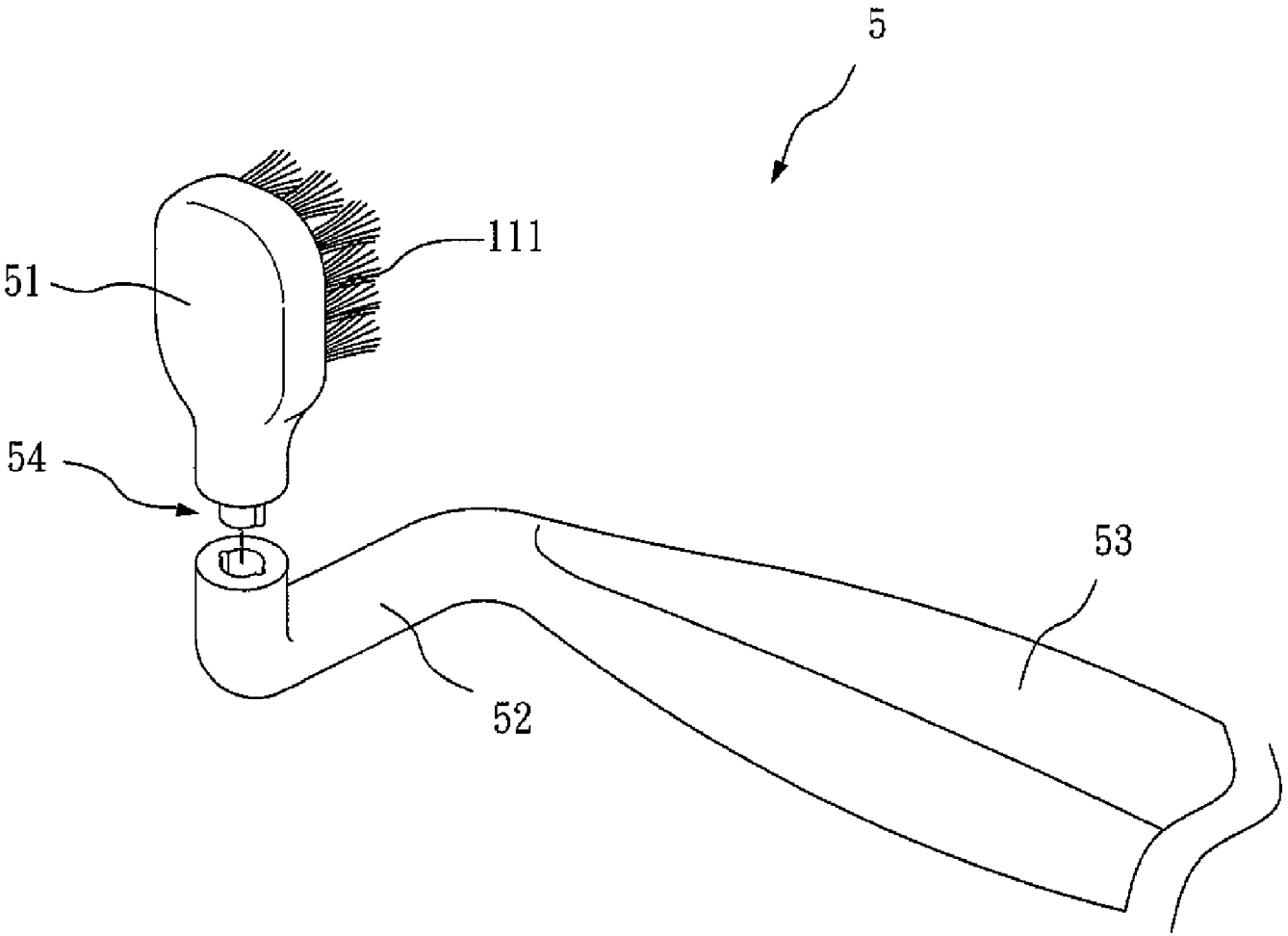

Refer to the embodiment as shown in FIG. 5. A toothbrush 5 comprises a head portion 51, an L-shaped neck portion 52 and a handle 53 extended from the L-shaped neck portion 52. In other words, this embodiment has essentially constructed the L-shaped neck portion 52 by joining the head portion 31 and the L-shaped member 311 shown in FIG. 3A into a single member. The head portion 51 can rotate with respect to the neck portion 52 by rotating along the fifth rotating member 54.

Figure 6:
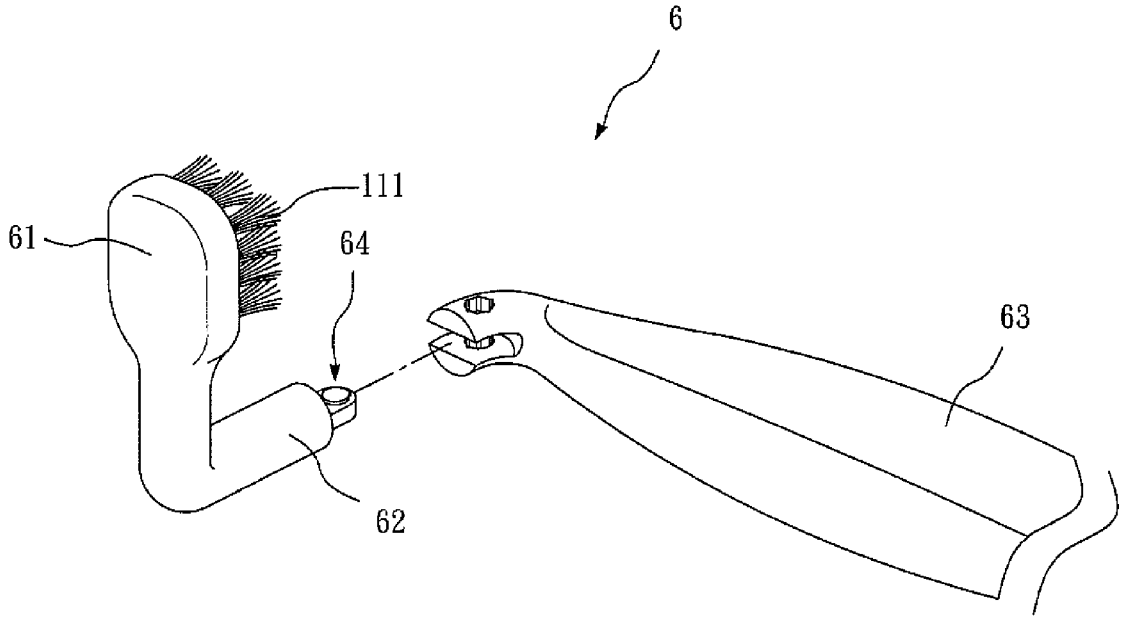

Refer to the embodiment as shown in FIG. 6. A toothbrush 6 comprises a head portion 61, a neck portion 62 and a handle 63. In other words, this embodiment has essentially joined the head portion 31, the L-shaped member 311 and the neck portion 32 shown in FIG. 3A into a single member. The neck portion 62 can rotate with respect to the handle 63 by rotating along the first rotating member 64.

Figure 7A:
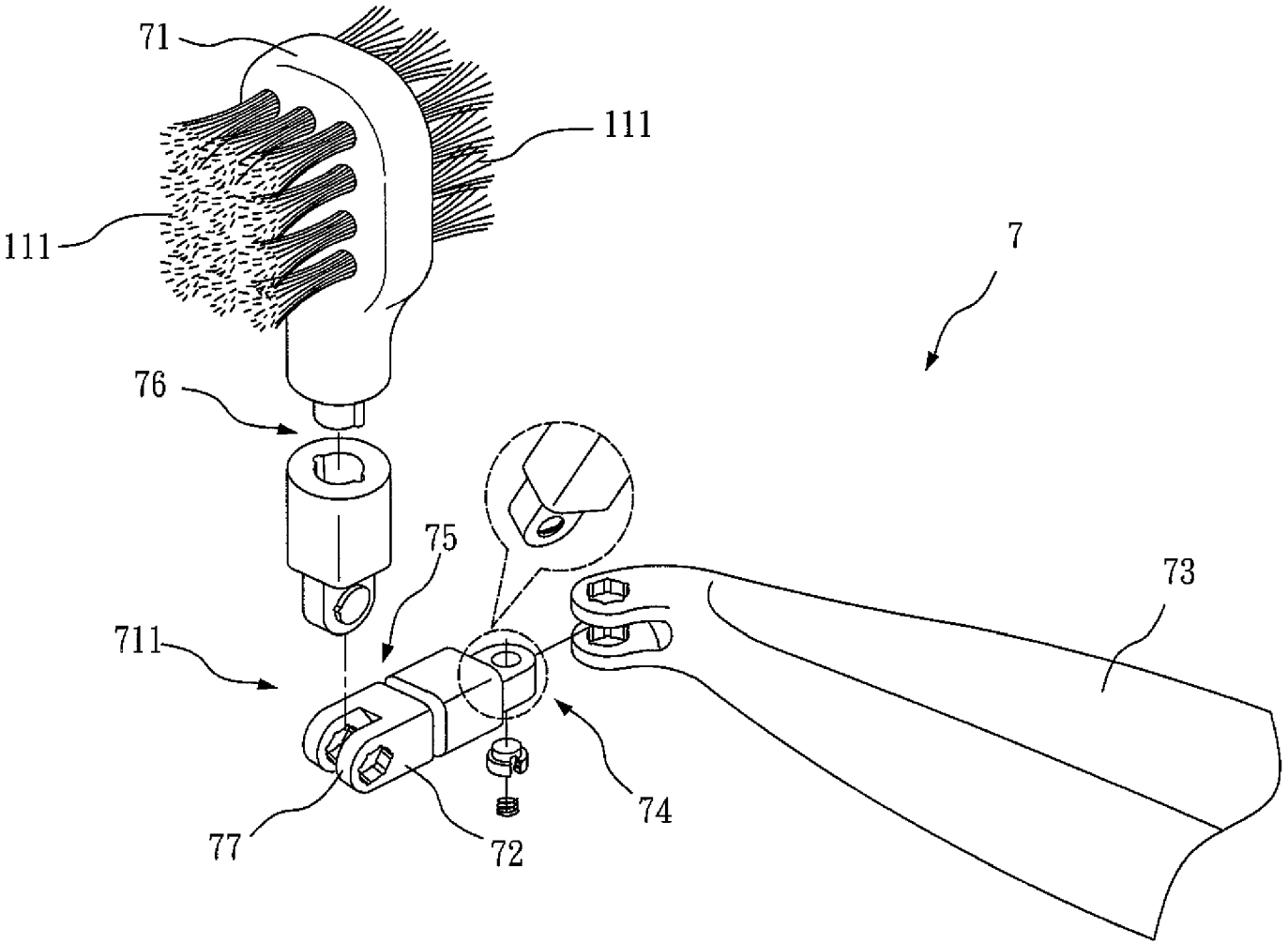
FIG. 7A to FIG. 7C are various embodiments of toothbrushes in accordance with the present invention.
Figure 7B:
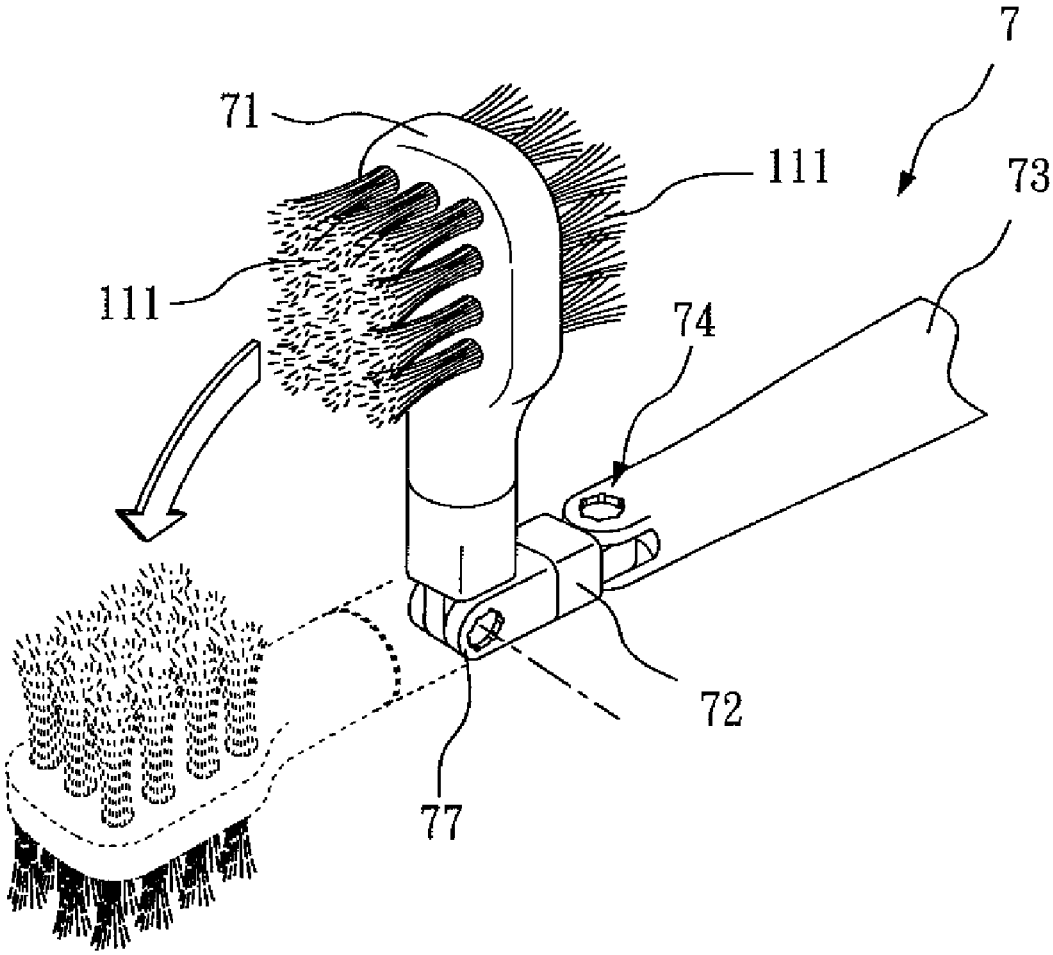
Figure 7C:
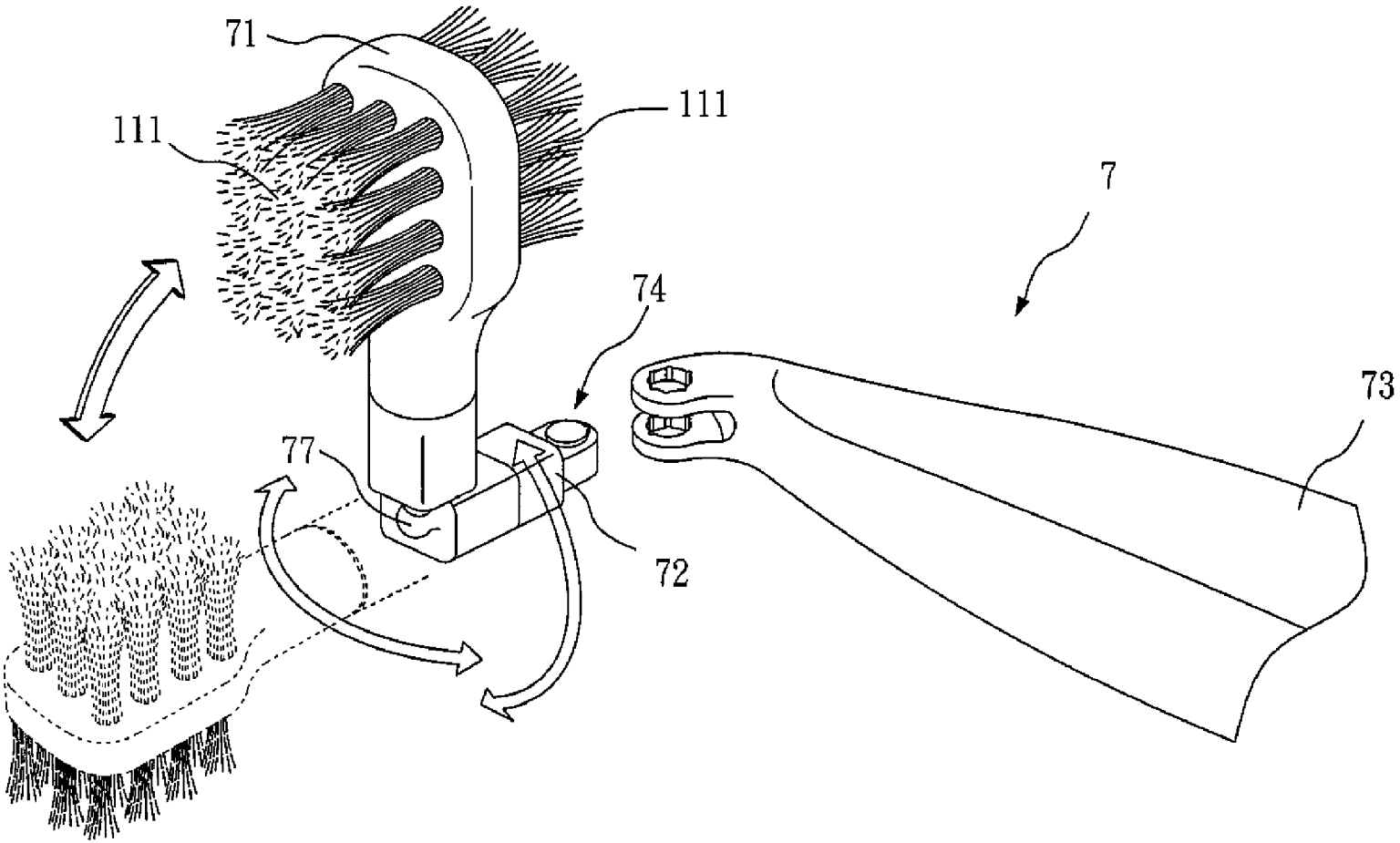

Refer to the embodiment as shown in FIG. 7A.about.FIG. 7C. A toothbrush 7 comprises a head portion 71, a neck portion 72, an L-shaped member 711 and a handle 73. The L-shaped member 711 and the handle 73 can be connected by a first rotating member 74. The L-shaped member 711 further comprises a fourth rotating member 77, such that the L-shaped member 711 can rotate along the fourth rotating member 77. Furthermore, the head portion 71 on the toothbrush 7 may have bristles 111 on both sides as shown in FIG. 7A.about.FIG. 7C.

As those skilled persons in this art will understand, the function of the first rotating member 34, 74; the second rotating member 35, 75; the third rotating member 36, 76; the fourth rotating member 77 or the fifth rotating member 44, 54 can also be achieved through other manners or devices such as pivot connections or ball joints to allow rotation (refer to FIG. 7C), so the present invention is not limited to the rotating members that have been illustrated. Furthermore, the first rotating member 34, 74; the second rotating member 35, 75; the third rotating member 36, 76; the fourth rotating member 77 or the fifth rotating member 44, 54 should not be limited to the position shown in the figures. For example, the second rotating member 35 can be located on the L-shaped member 311.

In addition, the toothbrush 1, 3, 4, 5, 6 or 7 of the present invention is not limited to be used as a traditional toothbrush which is brushed by hand movements, as the the design can also be applied with an electrical toothbrush (not shown). For example, the handle of the present invention can be inserted into the body of an electrical toothbrush.

In conclusion, the distinguishing feature of the present invention lies within the axis property of the head portion, the neck portion and/or the handle by providing the users with the convenience of cleaning the inner surface of teeth. The toothbrush can also have bristles on both sides of the head portion. Moreover, different types of rotating structures can be used on the head portion, neck portion and/or handle to allow rotation in different directions. Furthermore, the replaceable head portion can be replaced to cater to users with different requirements.

Although the present invention has been explained in relation to its preferred embodiments, it is to be understood that many other possible modifications and variations can be made without departing from the spirit and the scope of the invention as hereinafter claimed.

What is claimed is:

1. A toothbrush comprising:

a head portion having a plurality of bristles thereon and a free end, wherein the bristles are substantially parallel to each other;

a neck portion extended from the head portion; and a handle extended from the neck portion and having a free end; wherein the handle from the neck portion to the free end of the handle defines an axis, wherein the neck portion from the head portion to the handle defines an axis, wherein the head portion from the neck portion to the free end of the head portion defines an axis, wherein the bristles extend from the head portion along an axis, wherein the axis of the bristles is substantially parallel to the axis of the neck portion; wherein the axis of the neck portion and the axis of the handle form an angle between 90 and 150 degrees and define a first plane; and wherein the axis of the head portion and the axis of the neck portion define a second plane different than the first plane.

2. The toothbrush of claim 1, wherein an angle formed between the head portion and the neck portion lies between 70 and 100 degrees.

3. The toothbrush of claim 1, wherein the handle can rotate with respect to the neck portion.

4. The toothbrush of claim 3, wherein the neck portion or the handle comprises a first rotating member, wherein the handle is rotatable with respect to the neck portion by the first rotating member; and wherein the toothbrush further comprises a L-shaped member, wherein the L-shaped member is separately connected to the neck portion and the head portion.

5. A toothbrush comprising:

a head portion having a plurality of bristles, wherein the bristles are substantially parallel to each other;

a neck portion connected to the head portion;

a handle connected to the neck portion; and an L-shaped member, wherein the L-shaped member is separately connected to the neck portion and the head portion, wherein an axis of the bristles is substantially parallel to an axis of the neck portion, wherein the handle rotates with respect to the neck portion, wherein the L-shaped member or the neck portion comprises a rotating member, wherein the rotating member allows the head portion and the L-shaped member to rotate with respect to the neck portion in accordance with the rotating member.

6. The toothbrush of claim 5, wherein the L-shaped member or the head portion comprises a further rotating member allowing the head portion to rotate with respect to the L-shaped member by the further rotating member.

7. A toothbrush comprising:

a head portion having a plurality of bristles, wherein the bristles are substantially parallel to each other;

a neck portion connected to the head portion;

a handle connected to the neck portion;

wherein an axis of the bristles is substantially parallel to an axis of the neck portion and wherein the handle rotates with respect to the neck portion, wherein the neck portion or the handle comprises a first rotating member, wherein the handle rotates with respect to the neck portion by the first rotating member; and an L-shaped member, wherein the L-shaped member is separately connected to the neck portion and the head portion, wherein a bending section of the L-shaped member further comprises a further rotating member for shaping the L-shaped member.

8. The toothbrush of claim 1, wherein the neck portion and the head portion are substantially L-shaped; and wherein the head portion can rotate with respect to the neck portion.

9. The toothbrush of claim 8, wherein an angle formed between the head portion and the neck portion is between 70 and 100 degrees.

10. The toothbrush of claim 8, wherein the head portion or the neck portion comprises a rotating member allowing the neck portion to rotate with respect to the handle by the rotating member.

11. The toothbrush of claim 3, wherein the neck portion or the handle comprises a first rotating member, wherein the handle is rotatable with respect to the neck portion by the first rotating member.

12. The toothbrush of claim 4, wherein the L-shaped member or the neck portion comprises a second rotating member, wherein the second rotating member allows the head portion and the L-shaped member to rotate with respect to the neck portion in accordance with the second rotating member.

13. The toothbrush of claim 12, wherein the L-shaped member or the head portion comprises a third rotating member allowing the head portion to rotate with respect to the L-shaped member by the third rotating member.

14. The toothbrush of claim 13, wherein a bending section of the L-shaped member further comprises a fourth rotating member for shaping the L-shaped member.

* * * * *